US008082855B2

(12) United States Patent
Kennedy et al.

(10) Patent No.: US 8,082,855 B2
(45) Date of Patent: Dec. 27, 2011

(54) CENTER BOWL LINER WITH SPRING WASHER CONDUCTOR

(75) Inventors: James Kennedy, Zellenople, PA (US); Jon Kaufman, Beaver, PA (US)

(73) Assignee: A. Stucki Co., Moon Township, PA (US)

( * ) Notice: Subject to any disclaimer, the term of this patent is extended or adjusted under 35 U.S.C. 154(b) by 125 days.

(21) Appl. No.: 12/564,992

(22) Filed: Sep. 23, 2009

(65) Prior Publication Data

US 2010/0071586 A1 Mar. 25, 2010

Related U.S. Application Data

(60) Provisional application No. 61/099,256, filed on Sep. 23, 2008.

(51) Int. Cl.
*B61F 3/00* (2006.01)

(52) U.S. Cl. ..... 105/199.4; 105/199.1

(58) Field of Classification Search ..... 105/199.4
See application file for complete search history.

(56) References Cited

U.S. PATENT DOCUMENTS

| | | | | | |
|---|---|---|---|---|---|
| 2,859,978 | A * | 11/1958 | Brimhall | 280/124.123 |
| 3,352,986 | A * | 11/1967 | Doherty, Jr. | 337/368 |
| 3,437,860 | A * | 4/1969 | Ney | 313/377 |
| 3,944,298 | A * | 3/1976 | Cannon | 384/422 |
| 4,241,667 | A * | 12/1980 | Wulff | 105/199.4 |
| 4,308,801 | A * | 1/1982 | Cooper et al. | 105/199.4 |
| 4,329,780 | A * | 5/1982 | Somers | 29/848 |
| 4,341,162 | A * | 7/1982 | Mathieu | 105/199.4 |
| 5,443,015 | A * | 8/1995 | Rudibaugh et al. | 105/199.4 |
| 5,481,985 | A * | 1/1996 | Lin et al. | 105/199.4 |
| 5,558,025 | A * | 9/1996 | Kanjo | 105/199.4 |
| 5,823,803 | A * | 10/1998 | Majors | 439/98 |
| 5,908,001 | A * | 6/1999 | Burke et al. | 105/199.4 |
| 6,041,714 | A * | 3/2000 | Trent et al. | 105/199.4 |
| 6,136,240 | A * | 10/2000 | Burke et al. | 264/105 |
| 6,792,874 | B1 * | 9/2004 | Anderson et al. | 105/199.4 |
| 2004/0261653 | A1 * | 12/2004 | Coslovi | 105/199.4 |
| 2010/0071586 | A1 * | 3/2010 | Kennedy et al. | 105/199.4 |

OTHER PUBLICATIONS

PCT International Search Report, dated Nov. 16, 2009 (3 pages).
PCT Written Opinion of the International Searching Authority, dated Nov. 16, 2009 (6 pages).

* cited by examiner

*Primary Examiner* — Joe Morano, IV
*Assistant Examiner* — Jason C Smith
(74) *Attorney, Agent, or Firm* — Buchanan Ingersoll & Rooney PC

(57) ABSTRACT

A center bowl liner is provided for use between a center plate of a railroad car and a center bowl surface on a truck bolster. The center bowl liner includes a disc-shaped element having top and bottom surfaces and a central opening for receiving a center pin. A conductive spring washer is attached to the disc-shaped element, with the conductive spring washer having a contoured profile such that portions of the conductive spring washer are exposed at the top and bottom surfaces of the disc-shaped element and create an electrical connection between the railroad car center plate and the center bowl on the truck bolster. The disc-shaped element acts as a load-bearing element generally supporting the railroad car center plate. The conductive spring washer, since it has spring-like properties, will also undertake to bear a limited amount of the load of the railroad car center plate in addition to providing an electrical connection between the car and truck.

20 Claims, 7 Drawing Sheets

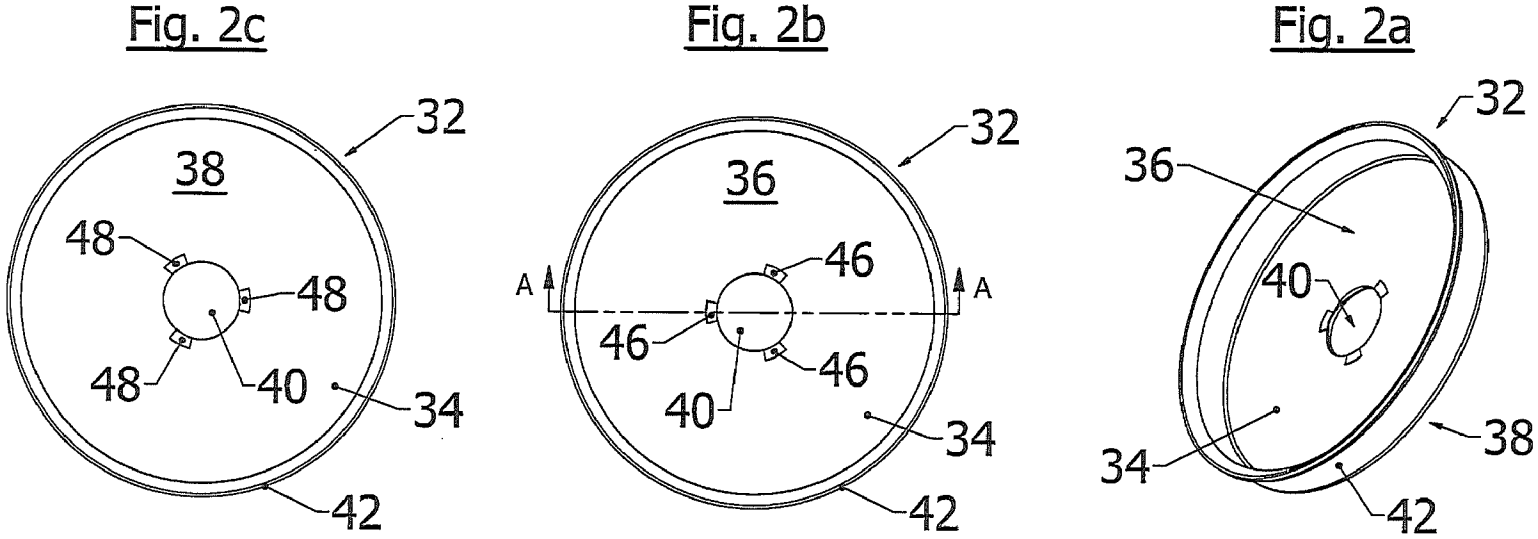
Fig. 2a
Fig. 2b
Fig. 2c
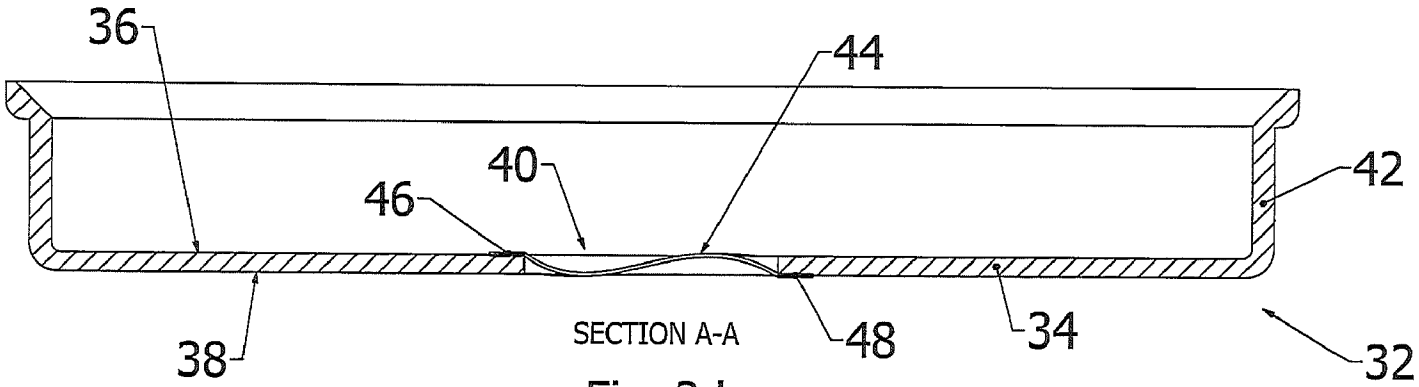
Fig. 2d

SECTION A-A

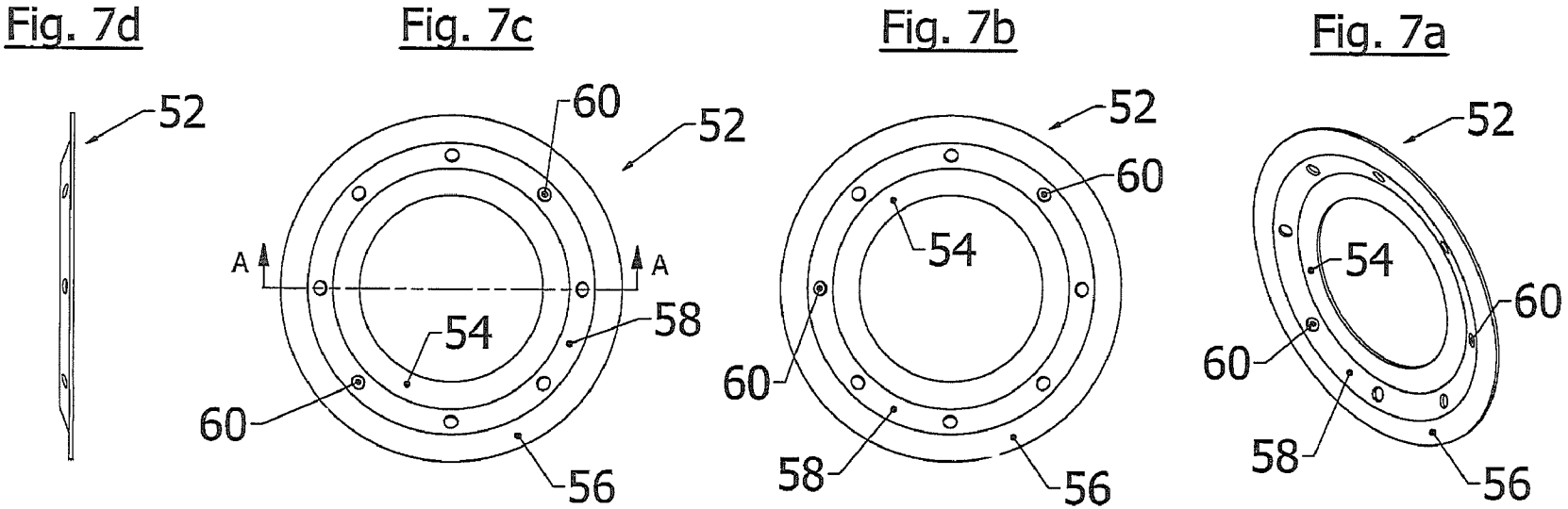
Fig. 7a
Fig. 7b
Fig. 7c
Fig. 7d
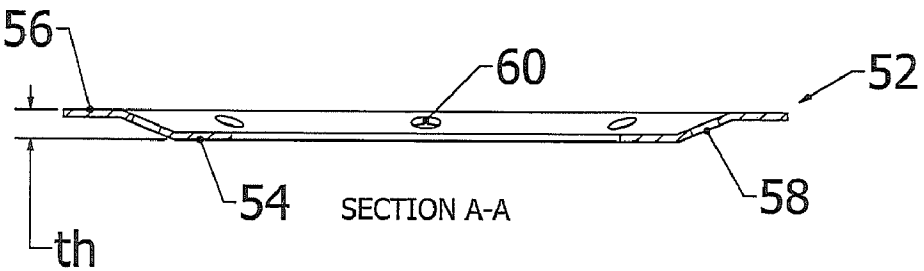
Fig. 7e

CENTER BOWL LINER WITH SPRING WASHER CONDUCTOR

CROSS-REFERENCE TO RELATED APPLICATIONS

This application claims the benefit of Provisional Patent Application Ser. No. 61/099,256 entitled "Non-Metallic Center Bowl Liner With Wave Spring Conductor", filed on Sep. 23, 2008, the entire disclosure of which is incorporated by reference herein.

FIELD OF THE INVENTION

The present invention is directed generally towards bowl liners for use in railroad cars and, more particularly, towards a bowl liner for use between a center plate of a railroad car and a center bowl surface on a truck bolster which includes a load bearing, disc-shaped element having top and bottom surfaces, and a conductive spring washer attached to the disc-shaped element and having a contoured profile such that portions of the conductive spring washer are exposed at the top and bottom surfaces of the disc-shaped element to create an electrical connection between the railroad car center plate and the center bowl on the truck bolster.

BACKGROUND OF THE INVENTION

In railroad freight cars, the center plate on the underside of the car body sits inside the center bowl on the truck bolster and is guided into position during assembly via the use of a center pin, or kingpin, that fits through the holes formed in the center bowl and the center plate. Typically, a liner is placed between the center plate and the center bowl surfaces to help reduce wear and/or modify the turning resistance of the truck. Historically, this liner has taken the form of a metallic horizontal disc that may also be used in conjunction with a metallic ring or an upstanding cylindrical wall at the outer perimeter of the disc to protect both the horizontal and vertical surface of the center bowl and center plate. However, these metal liners typically need to be lubricated periodically, which is burdensome and expensive.

In recent decades, railroad freight car builders and owners have started utilizing non-metallic horizontal or cup shaped liners. Some examples of non-metallic lines are the ultra-high molecular weight (UHMW) polyethylene and glass-filled polyester thermoplastic urethane (TPU) center bowl liners currently in the market today. These non-metallic center bowl liners can provide some benefits over traditional metallic liners, such as lower cost, ease of installation, lower coefficient of friction, reduced wear, etc. However, they are not without their own issues.

One drawback with the use of a non-metallic liner is that when a non-metallic liner is added between the car and the truck, there is no electrical continuity or conductivity between the car and the truck. Electrical conductivity between the car and the truck is important to provide a ground for the car body. Thus, use of a non-metallic liner can create an environment where static electric charge can build up in the car structure, resulting in a dangerous and unsafe condition. To combat this, manufacturers typically add a metallic or conductive material to the liner, such as metallic buttons or carbon black to provide some means of conductivity between the car and the truck to prevent the buildup of static electricity. Unfortunately, carbon black is not as conductive as metal and can be considered only an anti-static or semi-conducting material. On the other hand, while the metallic buttons provide sufficient conductivity, they can lift the car body out of the bolster bowl if they don't crush properly or they can become loose over time and fall out of the center bowl liner.

In addition, the non-metallic center bowl liner material itself is subject to failure. If the liner has a coefficient of friction that is too low, it can melt due to frictional heat generated by hunting, which is a violent oscillation of the truck relative to the car body. Furthermore, some materials, such as UHMW polyethylene, are prone to compression set, or "cold flow", when subjected to high compression loads, which can reduce the life of the component. As a result, some suppliers have chosen to add glass fibers to the non-metallic liner material to improve its compression set characteristics. However, under certain loading conditions, the glass can be abrasive and increase the rate of wear in the center bowl or center plate. Finally, UHMW polyethylene and glass-filled polyester TPU materials can become brittle and crack at low temperatures.

The present invention is directed toward overcoming one or more of the above-mentioned problems.

SUMMARY OF THE INVENTION

The center bowl liner of the present invention is designed for use between a center plate of a railroad car and a center bowl surface on a truck bolster. The inventive center bowl liner includes a disc-shaped element having top and bottom surfaces and a central opening for receiving a center pin. A conductive spring washer is attached to the disc-shaped element, with the conductive spring washer having a contoured profile such that portions of the conductive spring washer are exposed at the top and bottom surfaces of the disc-shaped element and create an electrical connection between the railroad car center plate and the center bowl on the truck bolster. The disc-shaped element acts as a load-bearing element generally supporting the railroad car center plate. The conductive spring washer, since it has spring-like properties, will also undertake to bear a limited amount of the load of the railroad car center plate in addition to providing an electrical connection between the car and truck.

In one form, the disc-shaped element is formed of a non-conductive material. In a further form, the non-conductive material is a polyether thermoset polyurethane.

In one form, the conductive spring washer is a conductive wave spring washer having a sinusoidal shape In a further form, the conductive spring washer has a bowl-shaped cross-section, with longitudinally offset inner and outer diameter portions connected by an angled middle portion.

In one form, the conductive spring washer is made of metallic material such as, but not limited to, a carbon steel.

In a further form, the conductive spring washer is integrally cast into the disc-shaped element adjacent the central opening thereof. The conductive spring washer may have an inner diameter that is smaller than the diameter of the central opening in the disc-shaped element to always guarantee exposed surface for conduction and/or to allow conduction by contact with the center pin.

In yet a further form, the disc-shaped element includes an upstanding cylindrical wall at an outer perimeter thereof. The upstanding cylindrical wall is typically made of the same material of the disc-shaped element, and is typically integrally cast therewith.

It is an object of the present invention to provide a generally non-conductive bowl liner for placement between the center plate of a railroad car and the center bowl surface on a truck bolster, while still providing an electrical connection between the railroad car center plate and truck bolster bowl surface to prevent static electric charge buildup.

It is a further object of the present invention to provide a center bowl liner for placement between the center plate of a railroad car and a center bowl surface on a truck bolster which maintains the standard benefits of a non-metallic liner including, but not limited to, lower cost, ease of installation, lower coefficient of friction, reduced wear, etc., while providing an electrical connection between the railroad car center plate and truck bolster bowl surface to prevent static electric charge buildup.

Other objects, aspects and advantages of the present invention can be obtained from a study of the specification, the drawings, and the appended claims.

BRIEF DESCRIPTION OF THE DRAWINGS

FIGS. 2*a-d* illustrate perspective, top, bottom and cross-sectional views, respectively, of the center bowl liner of the present invention;

FIGS. 7*a-e* illustrate perspective, bottom, top, side and cross-sectional views, respectively, of a conductive spring washer included in yet a further embodiment of the center bowl liner of the present invention.

DETAILED DESCRIPTION OF THE INVENTION

Figure 1:
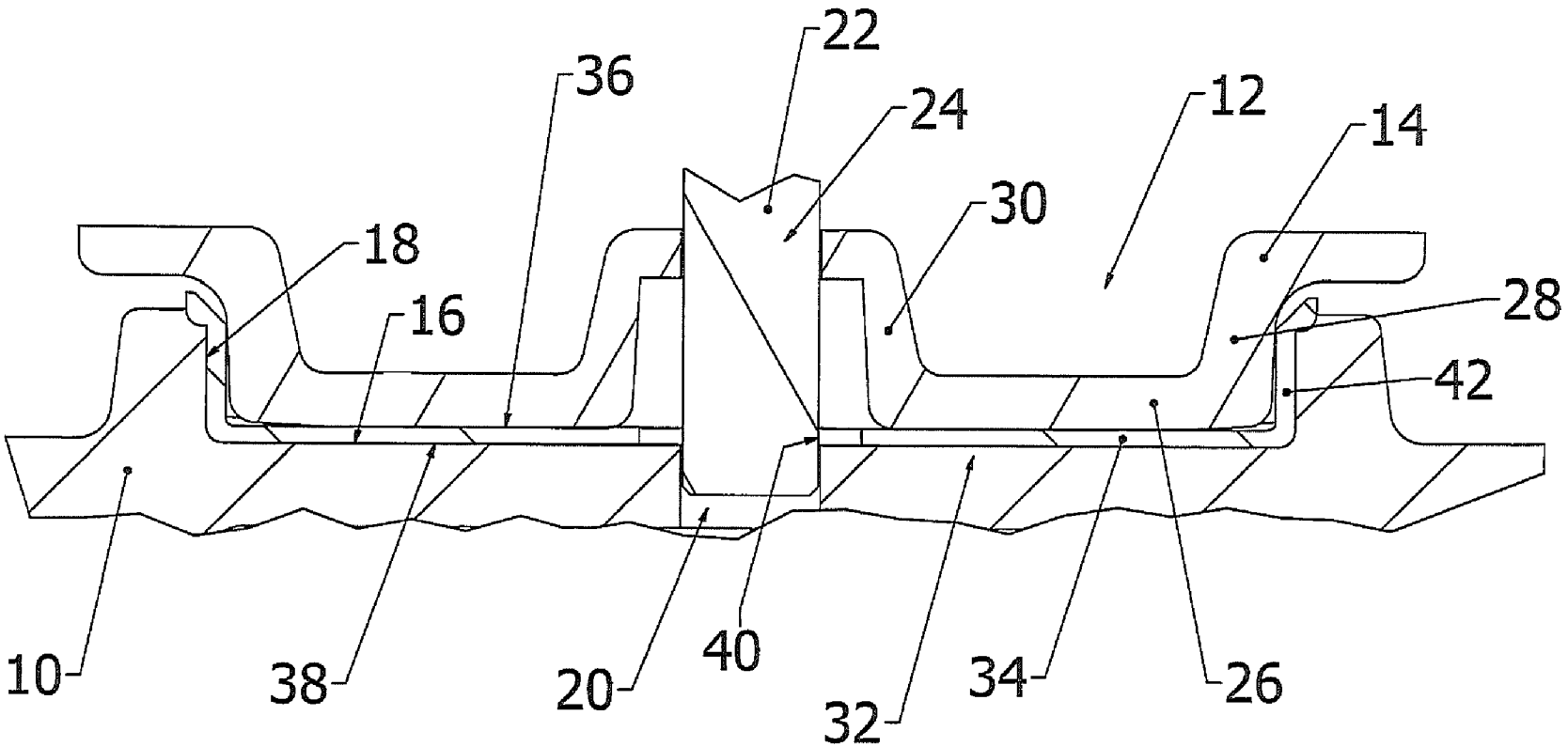
FIG. 1 is a cross-sectional view illustrating the inventive liner installed between a railroad car center plate and a truck bolster bowl surface.
Figure 3A:
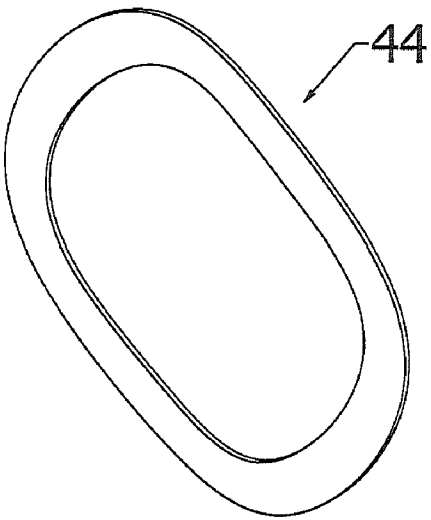
FIGS. 3*a-d* illustrate perspective, top, side and cross-sectional views, respectively, of a conductive wave spring washer included in the center bowl liner of the present invention.
Figure 3B:
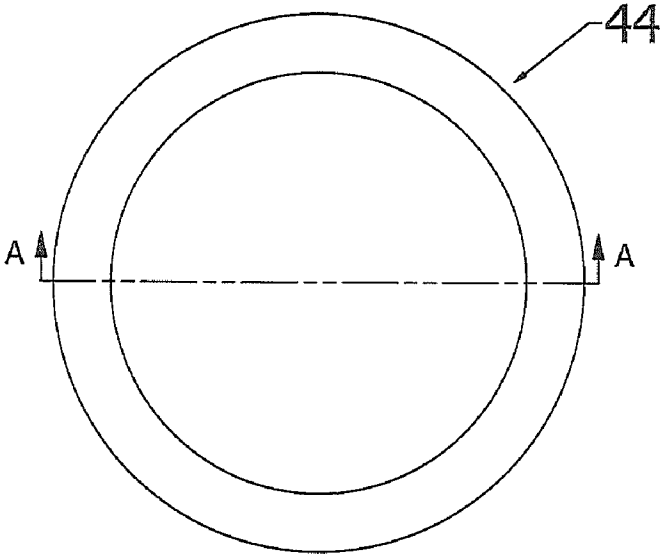
Figure 3D:
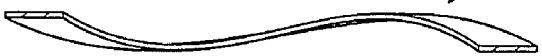
Figure 3C:
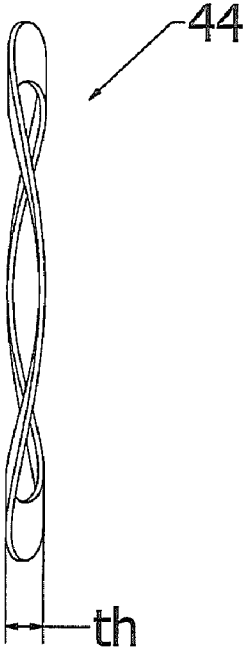
Figure 4A:
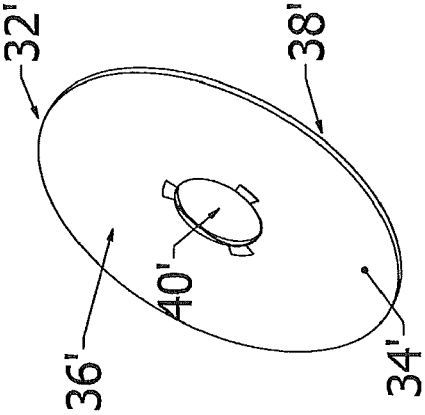
FIGS. 4*a-d* illustrate perspective, top, bottom and cross-sectional views, respectively, of an additional embodiment of the center bowl liner of the present invention.
Figure 4B:
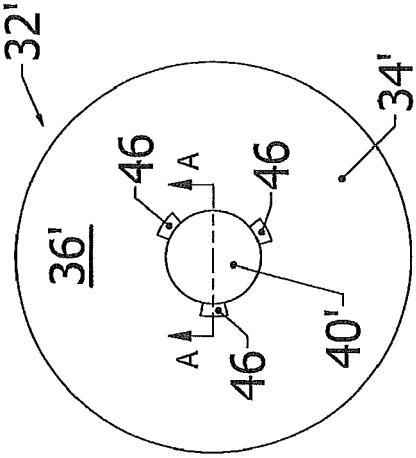
Figure 4C:
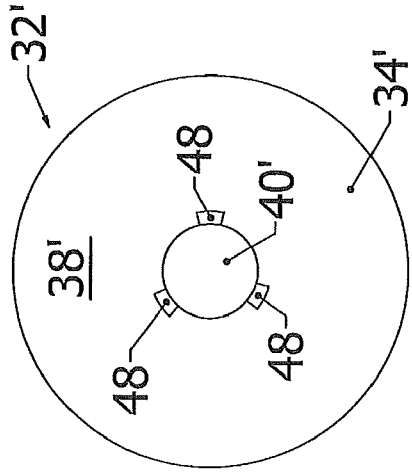
Figure 4D:
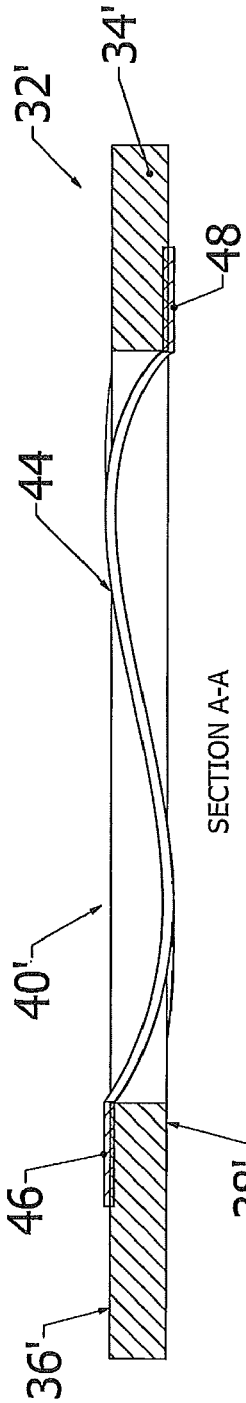
Figure 5A:
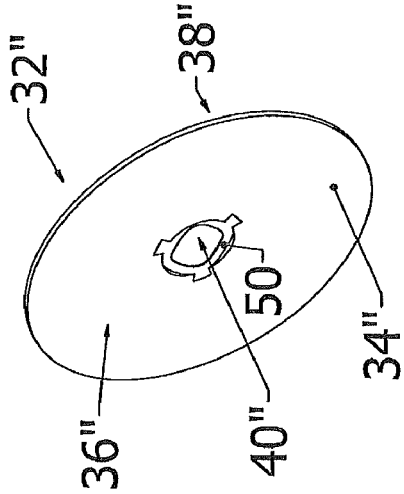
FIGS. 5*a-d* illustrate perspective, top, bottom and cross-sectional views, respectively, of a further embodiment of the center bowl liner of the present invention.
Figure 5B:
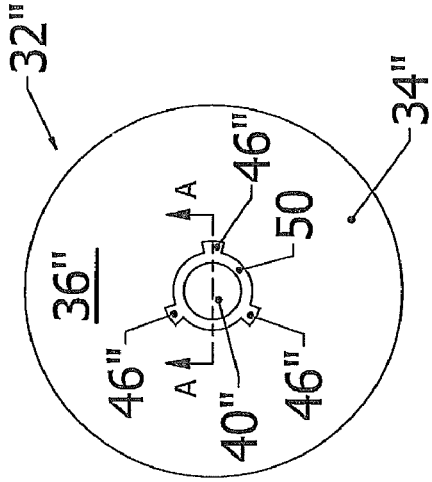
Figure 5C:
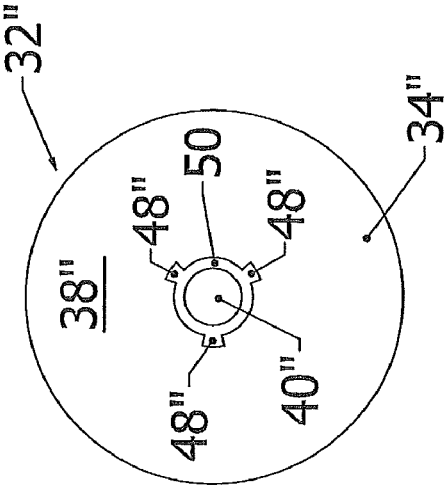
Figure 5D:
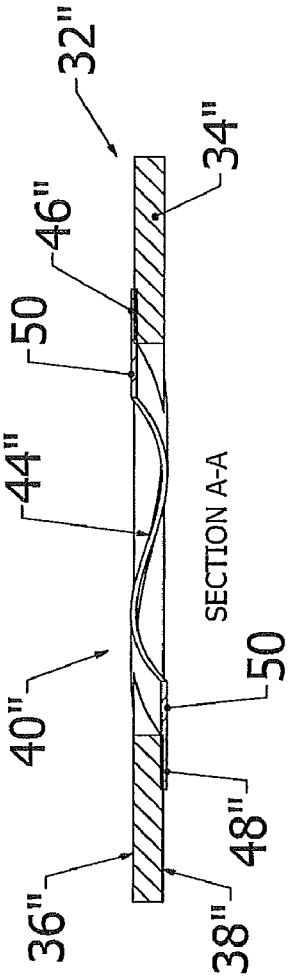
Figure 6A:
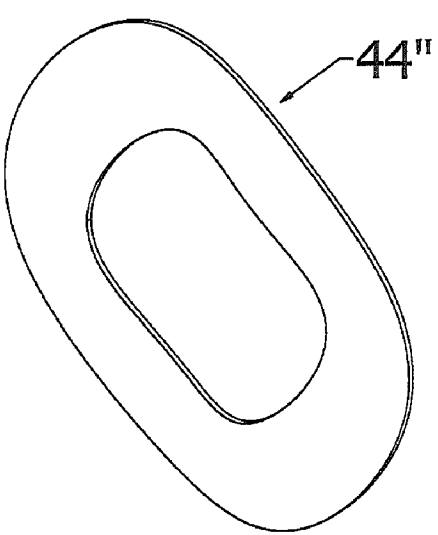
FIGS. 6*a-d* illustrate perspective, top, side and cross-sectional views, respectively, of a conductive wave spring washer included in a further embodiment of the center bowl liner of the present invention.
Figure 6B:
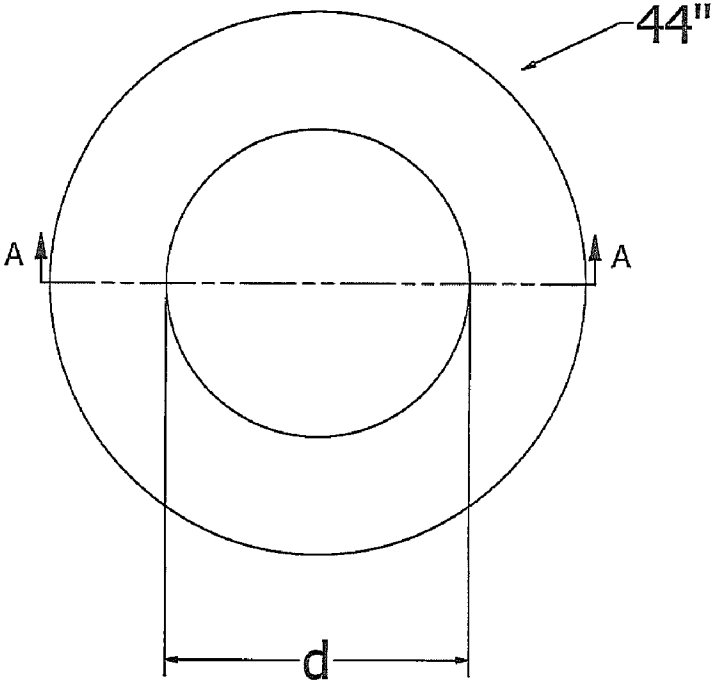
Figure 6C:
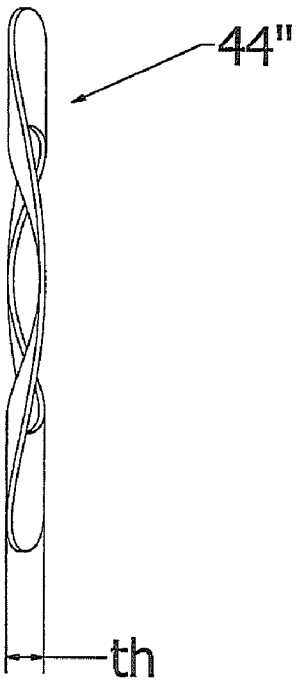
Figure 6D:
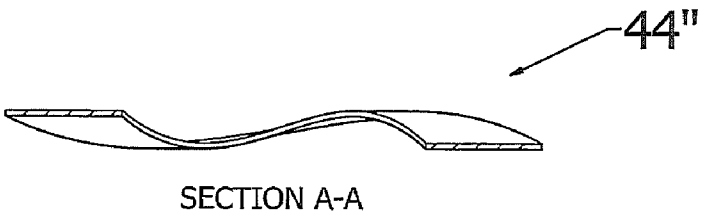

As shown in FIG. 1, a standard railroad car typically includes a truck bolster center plate 10 that is attached to or integrally formed with the truck bolster. A conventional truck bolster includes a frame having an axle to which wheels are attached which engage standard railroad tracks (not shown). The truck bolster center plate 10 defines a bowl surface 12 into which a railroad car center plate 14 is disposed. The bowl surface 12 includes a generally circular, horizontal floor base 16 and a generally vertically disposed upstanding side wall 18. The floor base 16 includes a centrally positioned aperture 20 for receiving a center pin 22, often called a kingpin, which extends upwardly through a central bore 24 in the railroad car center plate 14. The railroad car center plate 14 typically includes a horizontal circular base 26 connected to a generally vertically disposed perimeter wall 28, and also connected to a vertically extending tubular wall 30 through which the center pin 22 is received. The center pin 22 essentially defines the rotational relationship between the railroad car center plate 14 and the truck bolster center bowl surface 12.

The center bowl liner of the present invention is shown generally at 32 in FIG. 1, and is provided between the railroad car center plate 14 and the truck bolster center plate 10 that defines the center bowl surface 12. The center bowl liner 32 of the present invention provides a bearing surface between the railroad car center plate 14 and the truck bolster center bowl surface 12, and also provides an electrical connection there between to prevent electrical static charge buildup.

As shown in FIGS. 1-2, the center bowl liner 32 of the present invention includes a disc-shaped element 34 having top 36 and bottom 38 surfaces, and a central opening 40 for receiving the center pin 22. The disc-shaped element 34 includes an upstanding cylindrical wall 42 at an outer perimeter thereof. As shown in FIG. 1, the center bowl liner 32 fits in the truck bolster bowl surface 12 providing a liner between the railroad car center plate 14 and the bowl surface 12 of the truck bolster center plate 10.

Referring to FIGS. 2-3, the center bowl liner 32 includes a conductive wave spring washer 44 attached to the disc-shaped element 34. In one form, the conductive wave spring washer 44 is integrally cast with the disc-shaped element 34, which allows the material of the disc-shaped element 34 to uniquely and securely encapsulate the conductive wave spring washer 44 to prevent it from falling out in service. As shown in FIG. 2, the conductive wave spring washer 44 is attached (e.g., integrally cast) to the disc-shaped element 34 adjacent the central opening 40. However, the conductive wave spring washer 44 may be attached (e.g., integrally cast) at any radial position along the disc-shaped element 32 without departing from the spirit and scope of the present invention.

The conductive wave spring washer 44 has portions exposed at the top 36 and bottom 38 surfaces of the disc-shaped element 34 to create an electrical connection between the railroad car center plate 14 and the center bowl surface 12 on the truck bolster center plate 10. Portions 46 of the conductive wave spring washer 44 are exposed on the top surface 36 of the disc-shaped element 34 (see FIG. 2*b*). Portions 48 of the conductive wave spring washer 44 are exposed on the bottom surface 38 of the disc-shaped element 34 (see FIG. 2*c*). Due to the sinusoidal wave shape of the spring washer 44 (see FIG. 3), the portions 46 exposed at the top surface 36 will be at different points on the disc-shaped element 34 than the portions 48 exposed at the bottom surface 38.

The conductive wave spring washer 44 generally has a sinusoidal shape and may be made to have an appreciable thickness "th" (which is defined as the distance between the top most portion and the bottom most portion) that is either flush with or thicker than the thickness of the disc-shaped element 34. If the thickness "th" of the conductive wave spring washer 44 is flush with the thickness of the disc-shaped element 34, after being integrally cast, portions of the disc-shaped element 34 may be ground to expose portions 46, 48 of the conductive wave spring washer 44. The conductive wave spring washer 44 is designed with the appropriate stiffness to allow it to move in unison with the disc-shaped element 34 of the center bowl liner 32, which will reduce stresses in the components and maintain constant contact between the truck bolster bowl surface 12 and the railroad car center plate 14 for conduction purposes to prevent the buildup of static charge.

FIGS. 4*a-d* illustrate an additional embodiment of the inventive center bowl liner, shown generally at 32'. Like elements with respect to FIG. 2 will be indicated with the same reference number and elements requiring modification will be indicated with a prime (').

The center bowl liner 32' includes a disc-shaped element 34' having top 36' and bottom 38' surfaces, and a central opening 40' for receiving the center pin 22. The difference in the embodiment of FIG. 4 is that the center bowl liner 32' does not include an upstanding cylindrical wall. The center bowl liner 32' includes a conductive wave spring washer 44 attached to the disc-shaped element 34'. The conductive wave spring washer 44 is attached to the disc-shaped element 34' and operates to establish an electrical connection between the railroad car center plate 14 and the center bowl surface 12 on the truck bolster center plate 10 in the same manner as previously described with respect to FIG. 2, with the portions 46 exposed at the top surface 36' at different points on the disc-shaped element 34' than the portions 48 exposed at the bottom surface 38' due to the sinusoidal shape of the conductive wave spring washer 44.

FIGS. 5-6 illustrate a further embodiment of the inventive center bowl liner, shown generally at 32". Like elements with respect to FIGS. 2 and 4 will be indicated with the same reference number and elements requiring modification will be indicated with a double prime (''). The center bowl liner 32" includes a disc-shaped element 34" having top 36" and bottom 38" surfaces, and a central opening 40" for receiving the center pin 22. The center bowl liner 32" includes a conductive wave spring washer 44" attached to the disc-shaped element 34". The conductive wave spring washer 44" is attached to the disc-shaped element 34" and operates to establish an electrical connection between the railroad car center plate 14 and the center bowl surface 12 on the truck bolster center plate 10 in the same manner as previously described with respect to FIGS. 2 and 4, with the portions 46" exposed at the top surface 36" at different points on the disc-shaped element 34" than the portions 48" exposed at the bottom surface 38" due to the sinusoidal shape of the conductive wave spring washer 44".

Additionally, the embodiment of FIGS. 5-6 has the additional advantage that the conductive wave spring washer 44" has an inner diameter "d" that is smaller than the diameter of the central opening 40" in the disc-shaped element 34". Thus, the conductive wave spring washer 44" will have a portion 50 thereof that will always be exposed for conduction and/or to allow conduction by contact with the center pin 22.

While the center bowl liner of the present invention has been described thus far as incorporating a conductive wave spring washer having a sinusoidal shape, one skilled in the art will appreciate that the conductive spring washer may take on various contoured profiles without departing from the spirit and scope of the present invention. For example, as shown in FIG. 7, a conductive spring washer 52 having a bowl-shaped cross-section may be attached (e.g., integrally cast) to the disc-shaped member 34, 34', 34". The conductive spring washer 52 includes an inner diameter portion 54 longitudinally offset from an outer diameter portion 56, with the portions 54 and 56 connected by an angled middle portion 58. The appreciable thickness "th" of the conductive spring washer may be either flush with or thicker than the thickness of the disc-shaped element 34, 34', 34". If the thickness "th" of the conductive spring washer 52 is flush with the thickness of the disc-shaped element 34, after being integrally cast, portions of the disc-shaped element 34, 34', 34" may be ground to expose portions 54 and 56 of the conductive spring washer 52. The middle portion 58 includes apertures 60 therein to allow the material of the disc-shaped element 34, 34', 34" to extend there through and encapsulate and secure the conductive spring washer 52 to prevent it from falling out in service. The conductive spring washer 52 is designed with the appropriate stiffness to allow it to move in unison with the disc-shaped element 34, 34', 34", which will reduce stresses in the components and maintain constant contact between the truck bolster bowl surface 12 and the railroad car center plate 14 for conduction purposes to prevent the buildup of static charge.

The two general shapes of the conductive spring washer (sinusoidal and bowl-shaped) are illustrated herein for exemplary purposes only. One skilled in the art will appreciate that various spring washers having various contoured profiles may in utilized herein without departing from the spirit and scope of the present invention.

In a preferred form, the center bowl liner is made of a non-conductive polyether thermoset polyurethane material with an integrally cast carbon steel wave spring. This design will maintain the standard benefits of a non-metallic liner, which include lower cost, ease of installation, lower coefficient of friction, and reduced wear, while providing various enhancements over existing technologies available in the market today. However, the present invention is not limited to use of a non-conductive polyether thermoset polyurethane material and carbon steel, and various other materials may be utilized for the center bowl liner and the conductive spring washer without departing from the spirit and scope of the present invention. For instance, the present invention offers the following advantages and variations.

- A polyether thermoset polyurethane provides excellent resistance to compression set, wear, and cold flow, while providing superior high temperature performance over current materials due to its unique three-dimensional network of physical and chemical cross-links. These excellent mechanical properties also eliminate the need to add glass fibers, which can contribute to increased wear.
- The polyether thermoset polyurethane material has a lower coefficient of friction than a metallic center bowl liner, but higher than UHMW polyethylene, which will provide the appropriate wear resistance while minimizing the potential for truck hunting. It is contemplated that the coefficient of friction be approximately 0.35, but this is illustrative only and can be adjusted by adding friction modifiers such as, but not limited to, Synton.
- The spring washer is integrally cast into the urethane which allows the urethane to uniquely and securely encapsulate the spring to prevent it from falling out in service.
- The spring washer is truly a spring, with the appropriate stiffness allowing it to move in unison with the disc-shaped element of the center bowl liner which may be made of a thermoset polyurethane material. This will reduce stresses in the components and maintain constant contact between the center bowl and center plate for conduction purposes.
- The spring washer is metallic, which will provide direct electrical conduction between the center bowl and center plate. The path of conduction is not purely perpendicular to the center bowl and center plate, but follows the spring washer geometry.
- The main body portions of the center bowl liner is not limited to a polyether thermoset polyurethane material and may be composed of other non-metallic/non-conductive materials such as MDI or TDI polyester and/or polycaprolactone urethanes, injection molded plastic, thermoplastic urethanes, etc.
- The wave spring material is not limited to a carbon steel and can be composed of alternative materials, such as brass, copper, or even other elastomeric materials that have conductive properties, either naturally or through additives such as, but not limited to, carbon black or metal particles.
- The spring washer is not limited in geometric shape and various other shapes, geometries and contoured profiles can be utilized.
- The appreciable thickness of the spring washer could be flush with, or protrude beyond, the top and bottom surfaces of the disc-shaped element of the center bowl liner.

The conductive spring washer could have a smaller inside diameter than the central opening in the disc-shaped element of the center bowl liner to always guarantee exposed surface for conduction and/or to allow conduction by contact with the center pin.

The main shape of the center bowl liner does not need to be of constant thickness. For example, metallic or non-metallic circumferential and/or radial rings, posts, buttons, etc. can be added for strength or to vary the friction coefficient.

The center bowl liner is not limited to a purely non-conductive material for the disc-shaped element and vertically extending tubular wall, but may be made of a semi-conductive material or include conductive materials intermixed therein.

Friction modifiers can be added to adjust the friction properties.

The horizontal surface of the center bowl liner (i.e., the disc-shaped element) may be cast as concave or convex rather than flat to assist in contact between the center bowl and center plate.

While the present invention has described herein with particular reference to the drawings, it should be understood that various modifications could be made without departing from the spirit and scope of the present invention. Those skilled in the art will appreciate that various other modifications and alterations could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A center bowl liner for use between a center plate of a railroad car and a center bowl surface on a truck bolster, said center bowl liner comprising:

a non-conductive disc-shaped element having top and bottom surfaces and a central opening for receiving a center pin; and a conductive wave spring washer attached to the disc-shaped element and having a central opening for receiving the center pin, wherein portions of the conductive wave washer are exposed at the top and bottom surfaces and create an electrical connection between the railroad car center plate and the center bowl on the truck bolster.

2. The center bowl liner of claim 1, wherein the non-conductive disc-shaped element comprises a polyether thermoset polyurethane.

3. The center bowl liner of claim 1, wherein the conductive wave spring washer comprises a carbon steel.

4. The center bowl liner of claim 1, wherein the conductive wave spring washer is integrally cast into the non-conductive disc-shaped element.

5. The center bowl liner of claim 4, wherein the conductive wave spring washer is integrally cast into the non-conductive disc-shaped element adjacent the central opening thereof.

6. The center bowl liner of claim 5, wherein the conductive wave spring washer has an inner diameter that is smaller than the diameter of the central opening in the non-conductive disc-shaped element.

7. The center bowl liner of claim 1, wherein the non-conductive disc-shaped element includes an upstanding cylindrical wall at an outer perimeter thereof.

8. The center bowl liner of claim 1, wherein the conductive wave spring washer has a sinusoidal shape.

9. A center bowl liner for use between a center plate of a railroad car and a center bowl surface on a truck bolster, said center bowl liner comprising:

a disc-shaped element having top and bottom surfaces and a central opening for receiving a center pin; and a conductive spring washer attached to the disc-shaped element and having a central opening for receiving the center pin, the conductive spring washer having a contoured profile such that portions of the conductive spring washer are exposed at the top and bottom surfaces and create an electrical connection between the railroad car center plate and the center bowl on the truck bolster.

10. The center bowl liner of claim 9, wherein the conductive spring washer is integrally cast into the disc-shaped element.

11. The center bowl liner of claim 10, wherein the conductive spring washer is integrally cast into the disc-shaped element adjacent the central opening thereof.

12. The center bowl liner of claim 11, wherein the conductive spring washer has an inner diameter that is smaller than the diameter of the central opening in the disc-shaped element.

13. The center bowl liner of claim 9, wherein the portions of the conductive spring washer are exposed at different points on the top and bottom surfaces of the disc-shaped element to create an electrical connection between the railroad car center plate and the center bowl on the truck bolster.

14. The center bowl liner of claim 9, wherein the disc-shaped element comprises a non-conductive material.

15. The center bowl liner of claim 14, wherein the non-conductive material of the disc-shaped element comprises a polyether thermoset polyurethane.

16. The center bowl liner of claim 9, wherein the conductive spring washer comprises a metallic material.

17. The center bowl liner of claim 16, wherein the metallic material of the conductive spring washer comprises a carbon steel.

18. The center bowl liner of claim 9, wherein the conductive spring washer comprises a conductive wave spring washer having a sinusoidal shape.

19. The center bowl liner of claim 9, wherein the conductive spring washer includes a bowl-shaped cross-section having offset inner and outer diameter portions connected by an angled middle portion.

20. The center bowl liner of claim 9, wherein the disc-shaped element includes an upstanding cylindrical wall at an outer perimeter thereof.

* * * * *

UNITED STATES PATENT AND TRADEMARK OFFICE

CERTIFICATE OF CORRECTION

PATENT NO. : 8,082,855 B2
APPLICATION NO. : 12/564992
DATED : December 27, 2011
INVENTOR(S) : James Kennedy and Jon Kaufman It is certified that error appears in the above-identified patent and that said Letters Patent is hereby corrected as shown below:

On the title page item (75) Inventors, after James Kennedy, change "Zellenople" to --Zelienople--.

Signed and Sealed this
Twenty-seventh Day of March, 2012

David J. Kappos

David J. Kappos
*Director of the United States Patent and Trademark Office*